United States Patent [19]

Yasukata

[11] 4,417,532

[45] Nov. 29, 1983

[54] SUTURING INSTRUMENT FOR SURGICAL OPERATION

[75] Inventor: Eguchi Yasukata, Kunitachi, Japan

[73] Assignee: Janome Sawing Machine Industry Co., Ltd., Japan

[21] Appl. No.: 270,726

[22] Filed: Jun. 5, 1981

[30] Foreign Application Priority Data

Jun. 6, 1980 [JP] Japan ..... 55-75587

[51] Int. Cl.[3] ..... D05B 1/00

[52] U.S. Cl. ..... 112/169; 128/334 R

[58] Field of Search ..... 112/169, 185, 194, 195; 128/334 R, 334 C, 339, 326

[56] References Cited

U.S. PATENT DOCUMENTS

| | | | |
|---|---|---|---|
| 1,258,594 | 3/1918 | Miller | 112/169 |
| 2,479,017 | 8/1949 | Merson et al. | 112/169 |
| 2,507,814 | 5/1950 | Rantanen | 112/169 |
| 2,577,240 | 12/1951 | Findley | 128/325 |
| 3,957,004 | 5/1976 | Ketterer et al. | 112/169 |

*Primary Examiner*—H. Hampton Hunter

*Attorney, Agent, or Firm*—William A. Drucker

[57] ABSTRACT

A suturing instrument for use in surgical operation to suture up a wound or the cut out flesh with lock stitches substantially comprises a support, a needle bar secured to the support, a curved needle removably attached to one end of the needle bar and supplied with a needle thread, a holder bar mounted on the support and axially movable relative to the support to and away from a thread loop formed at the curved needle during the suturing operation, a shuttle holder mounted on one end of the holder bar, a shuttle removably mounted in a space defined by the shuttle holder and supplied with a shuttle thread, pawl means for detaining the shuttle in the space of the shuttle holder, said shuttle being of a streamlined structure pointed at the forward end thereof and having a rear end, said shuttle being positioned in the space of the shuttle holder in a manner that the pointed forward end thereof is directed to the support and the rear end thereof is directed to the curved needle, so that the shuttle may traverse on the outside of the thread loop formed at the curved needle with an advancing axial movement of the holder bar, and may traverse the thread loop on the inside thereof with a returning axial movement of the holder bar.

4 Claims, 14 Drawing Figures

FIG. 6
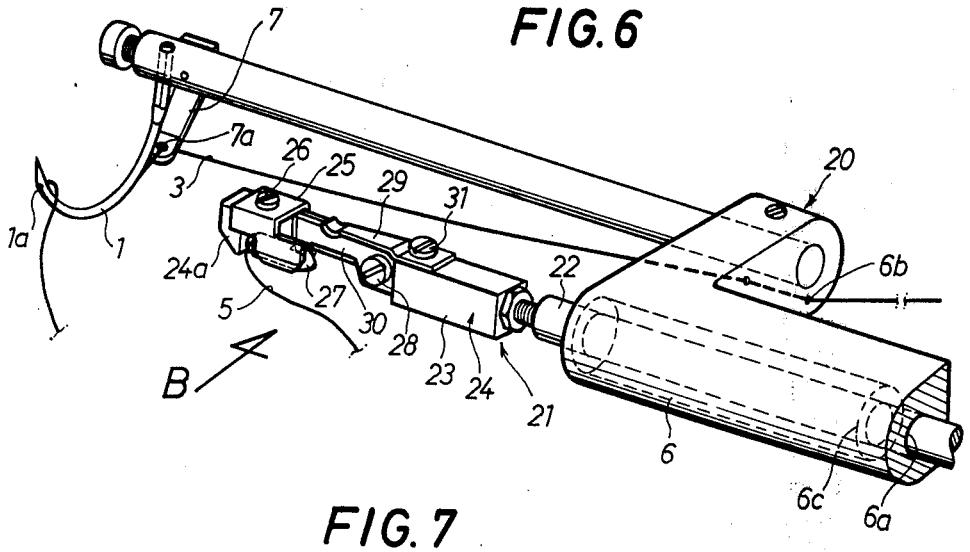
FIG. 7
FIG. 9
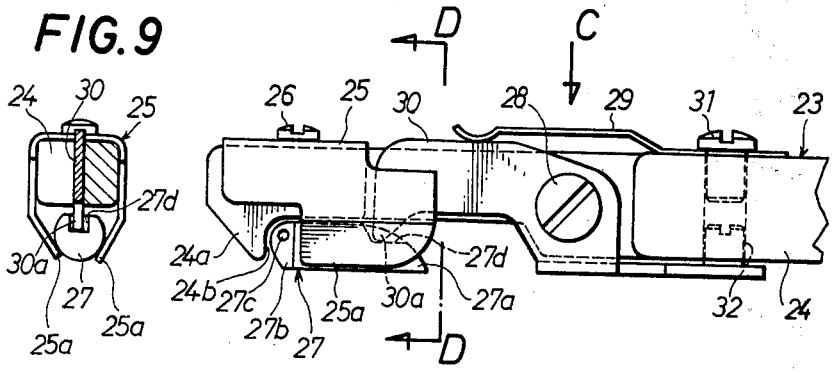
FIG. 8
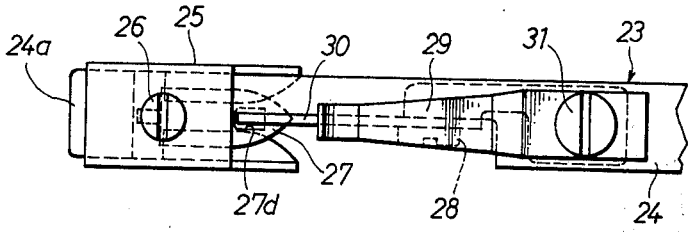

SUTURING INSTRUMENT FOR SURGICAL OPERATION

BACKGROUND OF THE INVENTION

The invention relates to a suturing instrument for use in surgical operation, especially for suturing up a wound or cut out skin with a series of lock stitches composed of a needle thread and a shuttle thread.

In the past, the surgical suturing operation has been made by means of a curved needle having a needle eye provided at the base thereof and a separate needle holder. After inserting a suture-thread through the needle eye, the operator clumps the base of the needle by the needle holder and pierces the needle into the flesh at one side of a wound or a cut out skin and projects the needle to the skin at the opposite side of the wound. Then the operator clamps the projected end of the needle with a holder and pulls the needle out of the skin to pass the suture-thread from one side to the opposite side of the wound. The suture-thread is then tied up per stitch. Thus the wound or cut out skin has been sutured up with a number of tied seams. Such a suturing operation is, however, time consuming, and is a physical burden to the patient.

For the purpose of improving the suturing operation, a suturing instrument has been proposed by the prior art (see Pat. No. 2,327,353) as shown in FIGS. 1 and 2, in which a curved needle 1 is removably attached to a needle bar 2. The needle has a needle eye 1*a* provided near the pointed end thereof and a groove 1*b* provided on the outer side of the needle shank therealong for guiding a needle thread 3 therein. The needle thread 3 is locked with a shuttle thread 5 carried by a shuttle 4 which is reciprocatingly moved with respect to the needle 1 to suture up the wound or cut out skin with lock stitches.

Namely, according to the suturing instrument, the needle thread 3 is drawn out of a bobbin (not shown) mounted on a support 6 and is passed through an eye 7*a* of a thread guide 7 and is then guided in the guide groove 1*b* of the needle 1 and is then passed through the needle eye 1*a*. When the curved needle 1 is pierced through the parts 8, 9 of skin, a crescent-shaped thread loop 3L is formed by a part 3*a* of thread extended between the needle eye 1*a* and the skin 9*a* and a part 3*b* of thread guided in the needle groove 1*b*. Then the shuttle 4 with the shuttle thread 5 is moved into the thread loop 3L to lock the part 3*a* of the thread loop 3L with the shuttle thread 5. Then the curved needle 1 is moved back and pulled out of the skin 8, 9 to tighten the two threads 3, 5, thereby to form a lock stitch. With repetition of such an operation, a series of lock stitches is formed to suture up the wound. As to the suturing instrument, the shuttle 4 has to be positioned on the side of the support 6 spaced from the needle so as not to be in the way when the needle is pierced into the skin to be sutured up. The shuttle 4 is required to reciprocate in a linear or a curved path between the needle 1 and the inoperative position at the side of the support 6 so as to lock the needle thread loop 3*a* with the shuttle thread 5.

According to this suturing instrument, the shuttle 4 is movably supported on the support 6 with the forward end thereof directed to the curved needle 1, so that the shuttle with the shuttle thread 5 may be passed into the needle thread loop 3L in the advancing movement toward the needle 1 for locking the thread loop 3*a* with the shuttle thread 5. The thread locking is completed while the shuttle 4 is returned to the inoperative position at the side of the support 6.

More precise explanation of this thread locking operation may be made in reference to the additional FIGS. 3–5.

The generally streamlined shuttle 4 is held within a shuttle holder 11 which is mounted on the support 6 and is reciprocatingly movable with respect to the curved needle 1 which is removably attached to the free end of the needle bar 2, the opposite end of which being secured to the support 6 as shown. Within the shuttle holder 11, the shuttle 4 is at the bottom thereof supported by a support plate 13. The forward end of the shuttle 4 is projected from the shuttle holder 11 and is pressed by the forked ends 16*a* of a pawl 16 having a shank turnably connected at one end thereof to the side walls 12 of the holder 11 by a pivot screw 14 and is biased in the counterclockwise direction in FIG. 4 by a spring 15. The shuttle 4 has a projection 4*a* with an eyelet 4*b* provided at the forward bottom thereof for connecting one end of the shuttle thread 5 thereto. After the loop 3L is formed, the shuttle holder 11 is moved in the direction as shown by an arrow E in FIG. 3, and the forward end of the shuttle 4 is passed below the straight part 3*a* of the needle thread loop 3L. As the holder 11 is advanced, the needle thread 3*a* is guided along the upper part of the shuttle 4 between the shuttle and the detaining ends 16*a* of the pawl 16 against the action of the spring 15. The needle thread 3*a* is further passed over the shuttle 4 and comes between the rear end of the shuttle 4 and the inner wall 12*a* of the holder 11. Then, as the holder 11 is moved back, the needle thread 13*a* is passed down between the rear end of the shuttle 4 and the inner wall 12*a* of the holder 11. As the holder 11 is further moved back, the needle thread 13*a* is passed towards the forward end of the shuttle guided between the bottom of the shuttle 4 and the support plate 13. Thus, the needle thread 3*a* is locked with the shuttle thread 5 as shown in FIG. 5 after the shuttle holder 11 is moved back to the inoperative position. According to the suturing instrument, the shuttle 4 with the pointed forward end is liable to hurt a part of the wound or the to be sutured as the shuttle 4 comes to a position shown by the two-dotted line in FIG. 5.

SUMMARY OF THE INVENTION

The present invention has been provided to eliminate the defects and advantages of the prior art, and it is a primary object of the invention to provide a novel suturing instrument of simple structure and of easy operation for continuously suturing up a wound or cut out skin of a patient.

It is another object of the invention to easily produce lock stitches for suturing up the wound without hurting a part of the wound or the cut out skin to be sutured up.

It is still another object of the invention to provide a suturing instrument which is so structured as to be easily manipulated by the operator.

For attaining these objects, the present invention substantially comprises a support, a needle bar secured to the support, a curved needle removably mounted to one end of the needle bar and supplied with a needle thread, a holder bar mounted on the support and axially movable relative to the support to and away from a thread loop forward at the needle during the suturing operation, a shuttle holder mounted on one end of the holder bar, a shuttle removably mounted in a space defined by the shuttle holder and supplied with a shuttle thread, pawl means for detaining the shuttle in the space of the shuttle holder, said shuttle being of a streamlined structure pointed at the forward end thereof and having a rear end, said shuttle being positioned in the space of the shuttle holder in a manner that the pointed forward end thereof is directed to the support and the rear end thereof is directed to the needle, so that the shuttle may traverse on the outside of the thread loop formed at the needle, and may traverse the thread loop on the inside thereof with a returning axial movement of the holder bar.

BRIEF DESCRIPTION OF THE DRAWINGS

In the accompanying drawings, FIGS. 1 through 5 show a prior art suturing device in which:

FIG. 1 is a perspective view showing an old suturing instrument and the operation mode thereof;

FIG. 2 is a perspective view showing a curved needle of the suturing instrument;

FIG. 3 is a perspective view showing a more precise structure of the suturing instrument shown in FIG. 1;

FIG. 4 is a side view of a portion of the instrument shown in FIG. 3 as seen in the direction of arrow A;

FIG. 5 is a perspective view showing a suturing process with the instrument shown in FIG. 3;

FIG. 6 is a perspective view showing a preferred embodiment of the suturing instrument according to this invention;

FIG. 7 is an enlarged side view of a portion of the suturing instrument shown in FIG. 6 as seen in the direction of arrow B;

FIG. 8 is a side view of the portion shown in FIG. 7 as seen in the direction of arrow C;

FIG. 9 is a sectional view taken along a line D in FIG. 7;

DETAILED DESCRIPTION OF THE INVENTION

Figure 1:
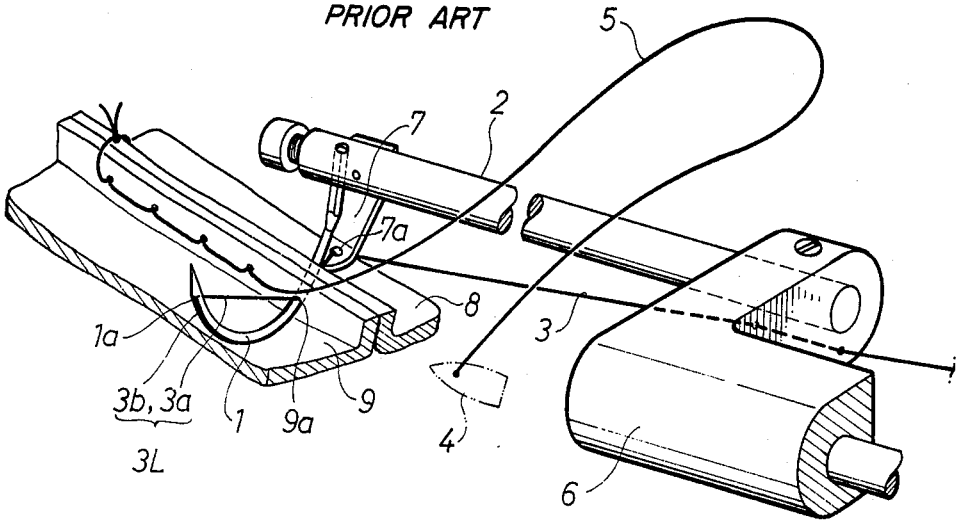
FIG. 1 PRIOR ART
Figure 2:
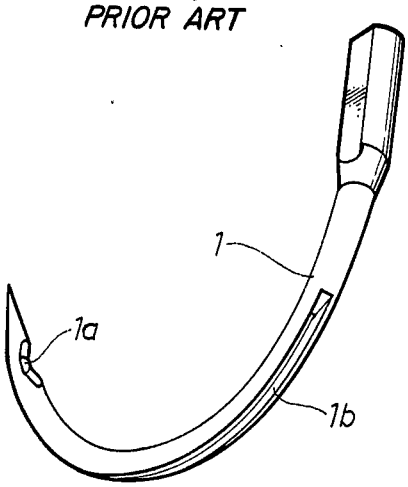
FIG. 2 PRIOR ART
Figure 3:
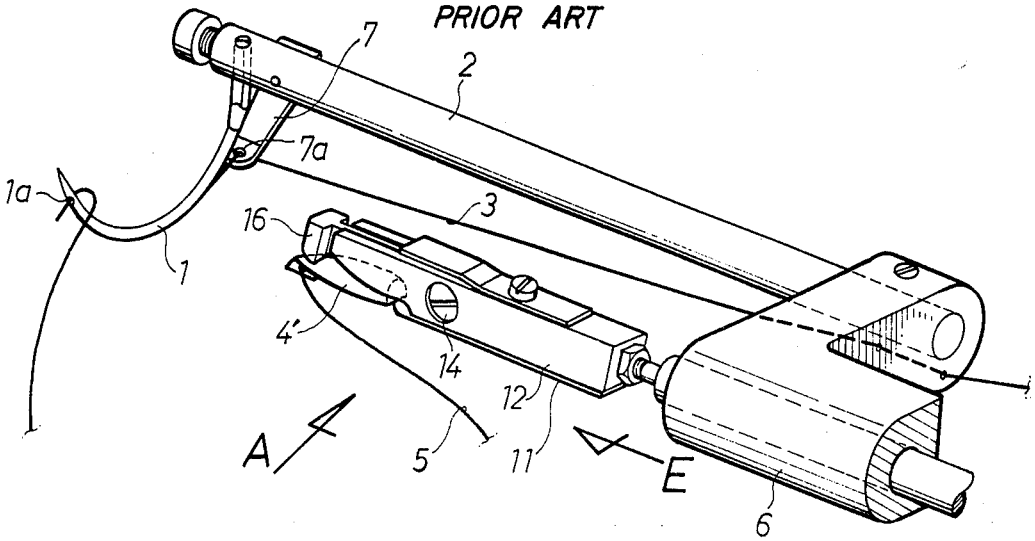
FIG. 3 PRIOR ART
Figure 4:
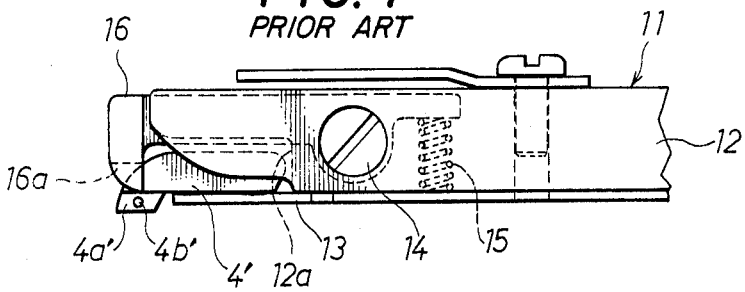
FIG. 4 PRIOR ART
Figure 5:
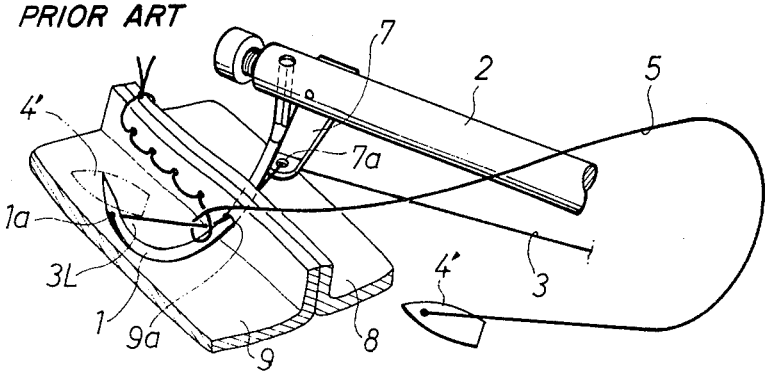
FIG. 5 PRIOR ART
Figure 10:
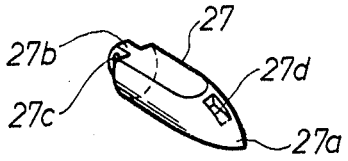
FIG. 10 is a perspective view of a shuttle of the instrument according to the invention.

A preferred embodiment of the invention is shown in FIGS. 6–14 in which the embodiment has the same parts with those of the prior art instrument as shown in FIGS. 1–5. These parts are indicated by the same reference numbers and the precise explanation thereof is omitted herein. In reference to FIG. 6, the suturing instrument 6 of the invention has the L-shaped support 6 which is gripped by the operator. The support 6 has a pinhole **6*b* provided in the laterally extended part thereof as shown for guiding therethrough the needle thread 3 to the needle 1 from a bobbin (not shown) which is mounted on the support 6. The support 6 is formed with a longitudinal bore 6*a* in which a rod 22 is slidable lengthwise of the support substantially in parallel with the needle bar 2. The longitudinal bore 6*a* is partly diametrically enlarged to the end of the support 6 on the side of the needle 1 defining an accommodation for normally receiving therein a shuttle holder 23 mounted on one end of the rod 22 on the side of the needle 1**.

In reference to FIGS. 7–10, the shuttle holder 23 is of an elongated structure having a base 24 directly connected to the end of the rod 22. The base 22 has a substantially U-shaped frame 25 secured to the extended end thereof by a fastening screw 26. The U-shaped frame 25 has a pair of spaced lower arms **25*a*, 25*a* bent towards each other defining a space for carrying therein a shuttle 27. The shuttle 27 is wholly streamlined at pointed forward end 27*a*, and has a lateral projection 27*b* provided at the rear end thereof. The projection 27*b* has an eyelet 27*c* to which one end of the shuttle thread 5 is connected. The shuttle 27 is placed in the space defined by the U-shaped frame 25 in a manner that the pointed forward end 27*a* is directed to the support 6 and the rear end with the eyelet 27*c* is directed to the needle 1. The shuttle 27 has a groove 27*d* formed at the top thereof near the pointed end 27*a*, which is engaged by a pointed end 30*a* of a detaining pawl 30, which is turnably mounted on the base 4 by a stepped screw 28 and is normally biased in the counterclockwise direction in FIG. 7 by a spring 29 which is at one end secured to the base 24 by a fastening screw 31 and is at the other end in contact with the pawl 30 to bias the pointed end 30*a* of the pawl 30 toward the groove 27*d* of the shuttle, so as to prevent the shuttle from being dropped from the space within the U-shaped frame 25. The pawl 30 has a bottom plate 30*b* extended toward the support 6 under the bottom of the base 24 to limit the counterclockwise movement of the pawl 30 for the purpose of providing a minimum clearance between the groove 27*d* of the shuttle 27 and the pointed end 30*a* of the pawl 30. The clearance may be adjusted by adjusting a lower projection of a screw 32 provided at the bottom of the base 24, which is to be engaged by the bottom plate 30*b* of the pawl 30**.

The surface of the shuttle 27 and the inner faces of the lower opposite arms **25*a*, 25*a* of the U-shaped frame 25 are made smooth so that the needle thread loop 3*a* (FIG. 1) may be easily passed through therebetween in the suturing operation as will be described hereinafter. A stopper 24*a* is secured to the free end of the holder 24 by the fastening screw 26. The stopper 24*a* is provided with an abutment 24*b* for limiting the leftward movement of the shuttle 27**.

Operation is as follows; Prior to the suturing operation, a shuttle thread 5 is at one end thereof tied to the eyelet **27*c* of the shuttle. Then the fastening screw 31 is loosened so that the pawl 30 may be allowed to turn in the clockwise direction around the stepped screw 28. The shuttle 27 is then inserted into the space defined by the U-shaped frame 25 in the manner that the forward pointed end 27*a* is directed to the base 24 of the holder 23, and then the screw 31 is fastened. The holder supporting bar 22 is then moved in the rightward direction in FIG. 6 until the shuttle holder 23 is completely received into the accommodation 6*c* of the support 6, so that the holder 23 may not stand in the way when the needle 1 is pierced into the flock 8, 9 to be sutured up. In the meantime the shuttle thread 5 is held by the operator or the assistant so that the shuttle thread 5 may not stand in the way of the needle 1 which is to be pierced in the skin. The needle thread 3 is inserted into the needle eye 1*a* of the needle 1 in the manner as described with respect to the prior art suturing instrument as shown in FIGS. 1–5**.

Figure 11:
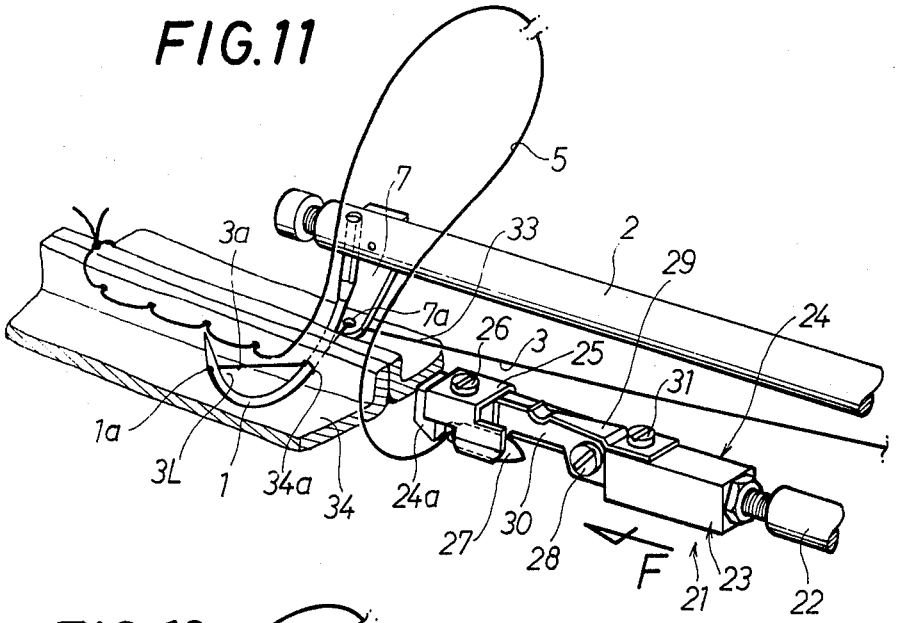
FIGS. 11, 12 and 14 are perspective views showing the steps of the suturing operation with the instrument of the invention.
Figure 12:
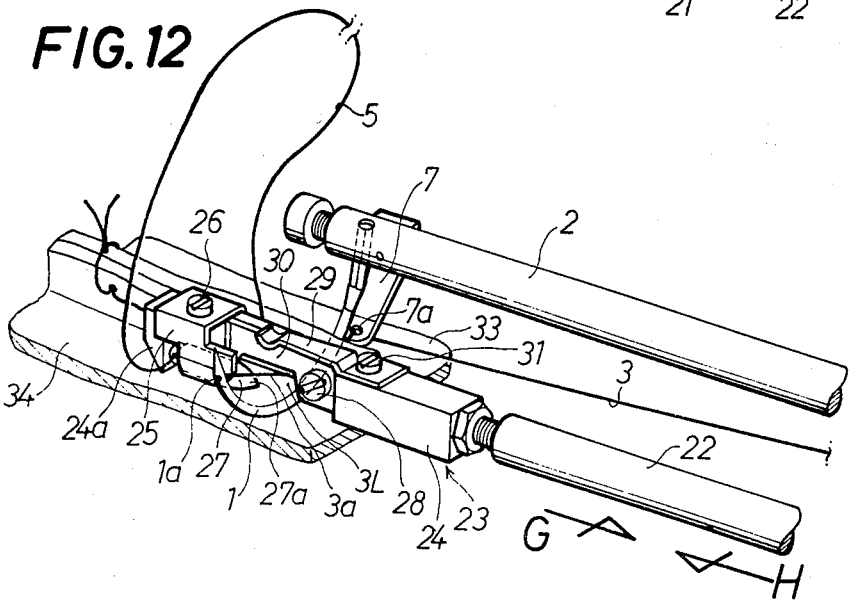
Figure 13:
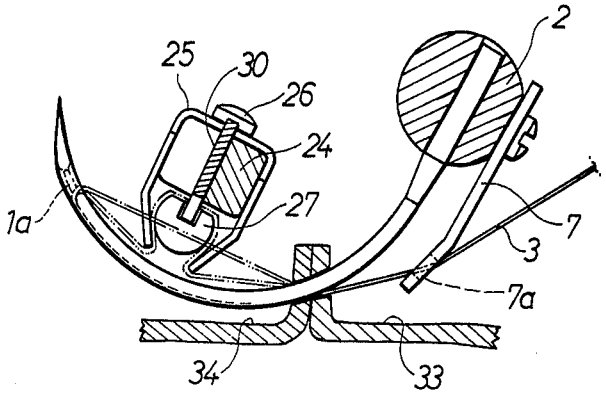
FIG. 13 is a sectional view showing the state of essential elements as seen in the direction of H when the shuttle is moved a little in the direction of arrow G from the state shown in FIG. 12.
Figure 14:
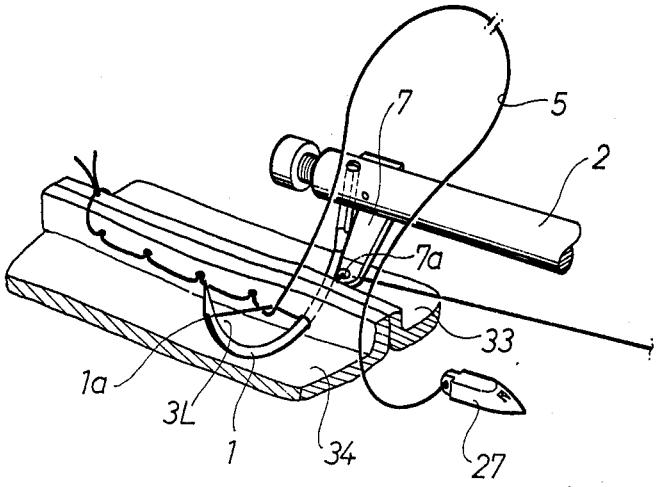

The operator grips the suturing instrument at the support 6 thereof and pierces the curved needle 1 into one side of the wound or the cut out skin 33, 34 and projects the needle 1 from the opposite side of the same. Then the part 3*a* of the needle thread 3 is stretched between the needle eye 1*a* and the side 34*a* of the wound from which the needle 1 is projected. Thus, a loop 3L is formed by the stretched part 3*a* of the thread 3 and the part of the thread 3 guided in the guide groove of the needle 1 as shown in FIG. 11. Subsequently, as the shuttle holder 23 is advanced towards the needle thread loop 3L, the stopper 24*a* of the holder 24 pushes down the stretched part 3*a* of the loop 3L. As the shuttle holder 24 is further advanced, the stretched thread 3*a* is guided along the bottom of the shuttle 27, and the shuttle 27 with the pointed forward end 27*a* gets over the stretched thread 3*a* and comes to the opposite side of the loop 3L with a maximum stroke of the shuttle holder 24 as shown in FIG. 12. In this condition, since the outer face of the stopper 24*a* is made smooth at the free end of the holder 24, the stopper 24*a* will not hurt a part of the wound or the cut out skin to be sutured up. Subsequently as the shuttle holder 24 is moved back, the pointed forward end 27*a* of the shuttle 27 traverses the stretched thread 3*a* of the loop 3L on the underside thereof. As the result, the stretched thread 3*a* is guided through the clearance between the pointed end 30*a* of the pawl 30 and the groove 27*d* of the shuttle 27 along the upper face of the shuttle 27, and is further guided through the clearance between the rear end of the shuttle 27 and the abutment 24*b* of the stopper 24*a*. Thus the stretched thread 3*a* of the loop 3L is locked with the shuttle thread 5 as shown in FIGS. 13 and 14.

As aforementioned, since the outer face of the shuttle 27 and the inner opposite faces of the lower arms 25*a*, 25*a* of the U-shaped frame 25 are made smooth, these will not hinder the passage of the stretched thread 3*a* of the loop 3L. Then the suturing instrument is operated again to draw back the curved needle 1 out of the fresh 33, 34, and the needle thread 3 and the shuttle thread 5 are tightened together to form a lock stitch for suturing up the wound. With repetition of the same suturing operation along the wound, a series of lock stitches are formed completely suturing up the wound or the cut out skin 33, 34.

What is claimed is:

1. A suturing instrument for surgical operation comprising:

(a) a support gripped by an operator, (b) a needle bar fixedly secured at one end thereof to the support, (c) a curved needle removably attached to the other end of the needle bar and supplied with a needle thread, (d) a holder bar mounted on the support and axially movable irrespectively of the stationary needle bar to and away from a thread loop formed at the curved needle during the stitching operation, (e) a shuttle holder mounted on one end of the holder bar, (f) a shuttle loosely received in a space defined by the shuttle holder and supplied with a shuttle thread, (g) means for detaining the shuttle in the space defined by the shuttle holder, said shuttle being of a streamlined structure pointed at one end thereof for guiding the thread loop therearound, said shuttle being positioned in the space in such manner that the pointed end thereof is directed to the support opposite from the curved needle, said shuttle holding bar being operated when said needle bar is kept standstill after the thread loop is formed so that the shuttle may traverse on the outside of the thread loop formed at the curved needle as the shuttle holding bar advances toward the needle, and may traverse the thread loop on the inside thereof as the shuttle holding bar returns to the support, thereby forming lock stitches with the needle and shuttle threads for suturing an incision under the surgical operation.

2. A suturing instrument as defined in claim 1, further comprising stopper means located at the forward end of the holder and providing an abutment cooperating with the pawl means to limit the axial movement of the shuttle in the space of the shuttle holder, said stopper means providing a clearance between the abutment and the rear end of the shuttle.

3. A suturing instrument as defined in claim 1, wherein said shuttle has a groove formed at the upper part thereof, and wherein said pawl means providing a shank which is at one end turnably mounted on the shuttle holder and providing a pointed end at the opposite end of the shank engaging the groove of the shuttle for limiting the axial movement of the shuttle in cooperation with the stopper means.

4. A suturing instrument as defined in claim 1, further comprising means adjustably mounted on the shuttle holder and adjusted to provide a suitable clearance between the pointed end of the pawl means and the groove of the shuttle, said means comprising a spring normally biasing the pointed end of the pawl means towards the groove of the shuttle and screw engaging a part of the pawl means to limit the turning movement of the pawl means in one direction.

* * * * *